United States Patent [19]

Nishiyama

[11] 4,259,995

[45] Apr. 7, 1981

[54] HARNESS FOR LOOMS

[75] Inventor: Hissai Nishiyama, Fuchu, Japan

[73] Assignee: Yoshida Kogyo K. K., Tokyo, Japan

[21] Appl. No.: 53,092

[22] Filed: Jun. 28, 1979

[30] Foreign Application Priority Data

Jul. 13, 1978 [JP] Japan ..... 53-96430

[51] Int. Cl.[3] ..... D03C 9/06

[52] U.S. Cl. ..... 139/92

[58] Field of Search ..... 139/91, 92

[56] References Cited

U.S. PATENT DOCUMENTS

| | | | |
|---|---|---|---|
| 3,169,555 | 2/1965 | Koyder et al. | 139/91 |
| 3,752,194 | 8/1973 | Griffith | 139/79 |
| 3,895,655 | 7/1975 | Sujdak | 139/92 |

FOREIGN PATENT DOCUMENTS

| | | | |
|---|---|---|---|
| 305164 | 2/1973 | Austria | 139/92 |
| 568 | 8/1880 | Italy | 139/92 |
| 956364 | 4/1964 | United Kingdom | 139/431 |

*Primary Examiner*—Henry Jaudon

*Attorney, Agent, or Firm*—Hill, Van Santen, Steadman, Chiara & Simpson

[57] ABSTRACT

A harness for narrow-fabric weaving looms comprises a plurality of heddles, a rectangular heddle frame including at least one pair of horizontal bars projecting from one of opposed vertical frame sides for supporting thereon the heddles at opposite ends of each heddle, and a heddle retainer on the heddle frame for preventing the heddles from shifting on the horizontal bars. The heddle retainer includes an elongate strip having a portion extending parallel to the horizontal bars. The portion of the strip is engageable with the heddles at one of the opposite ends of each heddle.

6 Claims, 6 Drawing Figures

HARNESS FOR LOOMS

BACKGROUND OF THE INVENTION

1. Field of the Invention

The present invention relates generally to narrow-fabric weaving looms, and more particularly to a harness for such looms.

2. Prior Art

Known harnesses for narrow-fabric weaving looms generally include a heddle frame with two pairs of heddle-supporting bars on which a plurality of heddles are mounted. Each of the heddle-supporting bars is supported as a cantilever only at one end by the heddle frame. A common problem encountered with the known harnesses is that the free ends of the heddle-supporting bars are liable to vibrate severely as the heddle frame is reciprocated vertically during weaving, thus often causing these bars as well as the heddles existing thereon to become broken or otherwise deformed.

SUMMARY OF THE INVENTION

It is therefore an object of the present invention to provide a harness for looms which can prevent the free ends of cantilever type heddle-supporting bars from shaking or vibrating during weaving.

Another object of the invention is to provide a harness for looms which can prevent heddles from shifting on the heddle-supporting bars.

According to the present invention, a harness for looms has a heddle retainer means mounted on a rectangular heddle frame for preventing the heddles from shifting on the heddle-supporting bars. the heddle retainer means comprises an elongate strip having a portion engageable with the heddles at one end of each heddle. The position of the strip is adjustable and to that end the strip has a pair of laterally spaced vertical slots, and the heddle frame has a pair of threaded holes. A pair of headed machine screws may extend through the slots into the threaded holes, respectively. With this arrangement, the heddle retainer strip, after loosening of the headed machine screws, can be moved vertically relatively to heddle-supporting bars to adjust the force of the strip on the heddles. Such force eliminates any objectionable induced or resonant vibration of the heddle-supporting bars.

Many other advantages, features and additional objects of the present invention will become manifest to those versed in the art upon making reference to the detailed description and the accompanying drawing in which preferred structural embodiments incorporating the principles of the present invention are shown by way of example.

DETAILED DESCRIPTION

Figure 1:
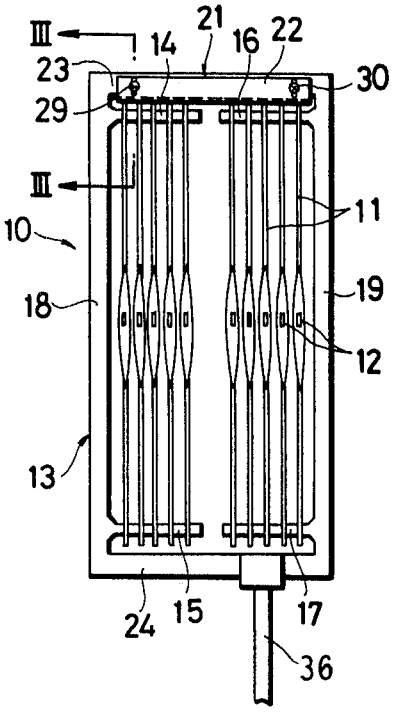
FIG. 1 is a front elevational view of a harness for looms according to the present invention.
Figure 2:
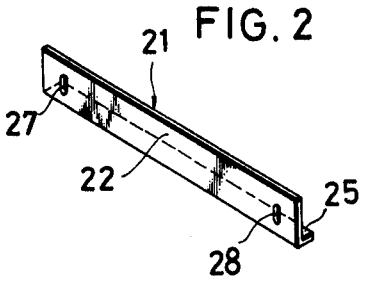
FIG. 2 is an enlarged perspective view of a heddle retainer of the harness shown in FIG. 1.

As shown in FIG. 1, a harness 10 for looms comprises a plurality of heddles 11 (ten in the illustrated embodiment) each having an eyelet 12 in its center through which a warp thread may pass in weaving, and an open heddle frame 13 supporting theron the heddles 11. The heddle frame 13 is generally rectangular, and includes first and second pairs of heddle-supporting bars 14,15 and 16,17 which project perpendicularly from and are supported as cantilevers by opposed vertical sides 18,19, respectively, of the rectangular frame 13. The first pair of bars 14,15 extends toward and terminates short of the second pair of bars 16,17, respectively, and vice versa.

The heddles 11 are divided into two groups carried separately by the first and second pairs of bars 14,15 and 16,17. Each heddle 11 has a pair of loops or holes 20,20 (FIG. 3) in its opposite ends, through which the first pair of bars 14,15 (or the second pair of bars 16,17), respectively, extend loosely. Thus, the heddles 11 are supported between the first pair of bars 14,15 and between the second pair of bars 16,17.

The harness 10 further comprises a heddle retainer 21 mounted on the heddle frame 13 to prevent the heddles 11 from shifting on the bars 14,15 and 16,17. Another function of the heddle retainer 21 is to prevent objectionable vibrations of the heddle-supporting bars 14,15,16,17 during weaving. The heddle retainer 21 is in the form of an elongate strip having an L-shaped cross section which is constituted by an upright support plate 22 extending on and along one of opposed horizontal sides 23,24 of the rectangular frame 13, and a presser plate 25 projecting horizontally from the support plate 22. The presser plate 25 is engageable at its underside with one of the ends 26 of the heddles 11 carried on the bars 14,15 and 16,17.

Figure 3:
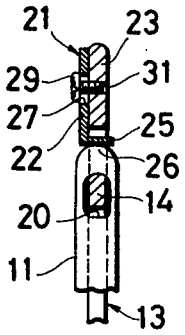
FIG. 3 is an enlarged cross-sectional view taken along line III—III of FIG. 1.

The support plate 25 has a pair of vertical slots 27,28 spaced remotely from each other along the support plate 22. As best shown in FIG. 3, a pair of headed machine screws 29,30 extends loosely through the two slots 27,28 respectively, and engages threadedly in a pair of threaded holes 31,31 respectively, in the horizontal frame side 23. Accordingly, the heddle retainer 21, after loosening of the headed machine screws 29,30, can be moved vertically relatively to the heddle frame 13 to adjust the force of the presser plate 25 that is applied to the heddles 11. Further, the heddles 11, after loosening of the headed machine screws 29,30, can e relocated on the bars 14,15 and 16,17 for replacement and positional adjustment.

Vertical reciprocation by a drive means 36 of the harness 10 imparts vibratons to the heddle-supporting bars 14–17 corresponding to an unknown or uncertain operating frequency including other vibration frequencies and/or harmonics originating elsewhere in the loom and transmitted by the drive means 36. To preclude any induced or resonant vibration of the bars 14, 16, the retainer 21, in acting on the bars 14,16 through the heddles 11, precludes such potentially harmful vibration thereof. Yet the retainer is both adjustable and retractable to facilitate replacement and/or respacing of any of the heddles 11.

Figure 4:
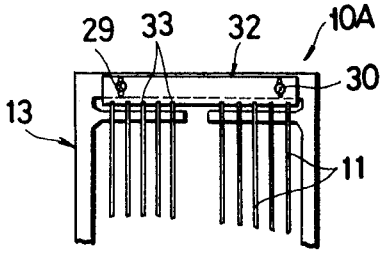
FIG. 4 is a fragmentary front elevational view of a modification of the harness.
Figure 5:
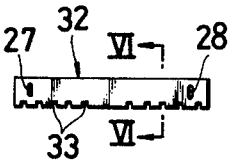
FIG. 5 is a front elevational view of a heddle retainer of the modified harness shown in FIG. 4.
Figure 6:
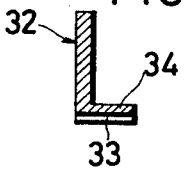
FIG. 6 is an enlarged cross-sectional view taken along line VI—VI of FIG. 5.

As shown in FIG. 4, a modified harness 10A according to a second embodiment differs from the harness 10 of FIG. 1 only in that a heddle retainer 32 has a plurality of grooves 33 in the undersurface of a presser plate 34 (FIG. 6) for receiving one end 26 (FIG. 3) of one of the heddles 11 in each groove. The grooves 33 are laterally spaced from one another and each extends transversely of the presser plate 34. With this arrangement, the spacing between adjacent heddles 11 can be maintained constant as desired during high speed weaving in spite of any minor vibration of the bars 14, 16 that may be present.

Although various minor modifications may be suggested by those versed in the art, it should be understood that I wish to embody within the scope of the patent warranted thereon all such embodiments as reasonably and properly come within the scope of my contribution to the art.

What I claim is:

1. A harness for looms comprising, in combination:

(a) a plurality of heddles;

(b) a rectangular heddle frame including at least one pair of horizontal bars projecting as a cantilever from one of opposed vertical sides of said rectangular frame for supporting thereon said heddles at opposite ends of each heddle; and (c) an elongate rigid strip extending parallel to said horizontal bars and adjustably secured to said heddle frame for vertical adjustment toward and away from the adjacent ends of said heddles, and engageable therewith for acting therethrough to prevent the free ends of the heddle bars from vibrating.

2. A harness according to claim 1, said portion of said strip having a plurality of laterally spaced rigid grooves each receptive of one of said heddles at one end thereof.

3. A harness for looms, comprising:

(a) a centrally open frame having a pair of heddle-support bars extending as cantilevers from said frame;

(b) a plurality of heddles carried on said heddle-support bars; and (c) means adjustably supported on said frame and having a rigid surface disposed to engage said heddles with a force for inhibiting vibration of the free end of at least one of said heddle-supporting bars.

4. A harness according to claim 3, said portion of said strip having a plurality of laterally spaced rigid grooves each receptive of one of said heddles at one end thereof.

5. A harness for looms comprising in combination:

(a) a plurality of heddles;

(b) a rectangular heddle frame including at least one pair of horizontal bars projecting from one of opposed vertical sides of said restangular frame for supporting thereon said heddles at opposite ends of each heddle; and (c) a heddle retainer means on said heddle frame for preventing said heddles from shifting on said horizontal bars, said heddle retainer means comprising an elongate strip having a portion which extends parallel to said horizontal bars, said portion being engageable with said heddles at one end of the ends of each heddle, said strip having a pair of laterally spaced vertical slots through which a pair of headed machine screws, respectively, extend, said heddle frame having a pair of threaded holes into which said pair of headed machine screws extend respectively, said strip, after loosening of said pair of headed machines screws, being movable vertically relatively to said horizontal bars.

6. A harness for looms comprising:

(a) a centrally open frame having a pair of heddle-supporting bars extending as cantilevers from said frame;

(b) a plurality of heddles carried on said heddle-supporting bars; and (c) means adjustably supported on said frame and disposed to engage said heddles with a force for inhibiting vibration of the free end of at least one of said heddle-supporting bars, said vibration inhibiting means comprising an elongate strip having a portion which extends parallel to said heddle-supporting bars, said strip having a pair of laterally spaced slots through which a pair of headed machine screws extend, said frame having a pair of threaded holes into which said pair of headed machine screws extend, said strip, after loosening of said pairs of headed machine screws, being movable relatively to said bars.

* * * * *